United States Patent [19]

Ahtola et al.

[11] Patent Number: 4,648,467

[45] Date of Patent: Mar. 10, 1987

[54] PRESSURE FLUID OPERATED PERCUSSION DRILLING MACHINE PROVIDED WITH A ROTATION MECHANISM

[75] Inventors: Unto Ahtola; Jaakko Kuusento, both of Tampere, Finland

[73] Assignee: Oy Tampella Ab, Tampere, Finland

[21] Appl. No.: 661,563

[22] Filed: Oct. 16, 1984

[30] Foreign Application Priority Data

Oct. 28, 1983 [FI] Finland ..... 833962

[51] Int. Cl.[4] ..... B25D 9/20

[52] U.S. Cl. ..... 173/107; 173/DIG. 4; 91/189 A; 92/2

[58] Field of Search ..... 173/107, 134, 104, 105, 173/DIG. 4; 91/61, 189; 92/2

[56] References Cited

U.S. PATENT DOCUMENTS

| | | | |
|---|---|---|---|
| 3,741,316 | 6/1973 | Alajreuanine | 173/107 |
| 3,965,799 | 6/1976 | Juronen et al. | 173/DIG. 4 |
| 4,039,033 | 8/1977 | Salmi | 173/105 |
| 4,103,746 | 8/1978 | Reynolds | 173/107 |
| 4,289,209 | 9/1981 | Salini | 173/107 |

FOREIGN PATENT DOCUMENTS

| | | | |
|---|---|---|---|
| 2023054 | 12/1979 | United Kingdom | 173/107 |

*Primary Examiner*—Donald R. Schran
*Assistant Examiner*—James L. Wolfe
*Attorney, Agent, or Firm*—Ladas & Parry

[57] ABSTRACT

Pressure fluid operated percussion drilling machine comprising a frame (1) forming a cylinder space (2) for an axially movable percussion piston (3). The frame is provided with channels (4,7) connectable to a pressure fluid source (5) and to a pressure fluid container (8) respectively for pressurizing the cylinder space alternately on each side of the percussion piston in order to move it back and forth. The frame is also provided with means (12) for connection of a drilling rod (13) to the frame for directing strokes on the drilling rod by means of the percussion piston. A pressure fluid operated rotation mechanism (18) is mounted on the frame for rotating the drilling rod, which mechanism is connected to said channels for rotating the mechanism by means of a pressure fluid. The frame is provided with two outlet channels (7,19) terminating in the cylinder space at a distance from each other in the direction of movement of the percussion piston. One of said outlet channels is connected to the rotation mechanism and the other to the pressure fluid container so that the percussion piston distributes the pressure fluid displaced out from the cylinder space in a desired proportion between the fluid container and the rotation mechanism.

4 Claims, 3 Drawing Figures

Figure 1:
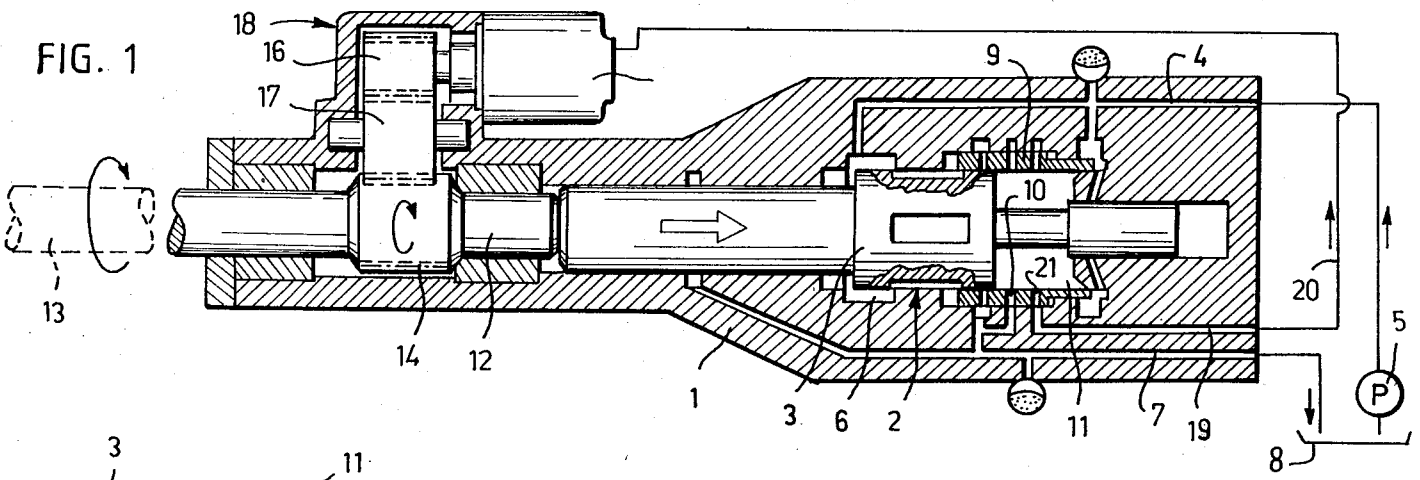

PRESSURE FLUID OPERATED PERCUSSION DRILLING MACHINE PROVIDED WITH A ROTATION MECHANISM

This invention relates to a pressure fluid operated percussion drilling machine, comprising a frame forming a cylinder space, a percussion piston moving axially in said cylinder space, an inlet and a first outlet channel located in the frame and connectable to a pressure fluid source and to a pressure fluid container respectively in order to move the percussion piston back and forth by means of pressure fluid, a valve for controlling the percussion movement of the piston, means for attaching a drilling rod to the frame as an extension of the cylinder space, and a pressure fluid operated rotation mechanism for rotating the drilling rod, which mechanism is connected to said cylinder space of the percussion piston through a second outlet channel for rotating the rotation mechanism by means of the pressure fluid discharged from the cylinder space.

From ZA-patent application No. 76/5367 a drilling machine is earlier known, which is provided with a pressure fluid operated rotation mechanism for rotating the drilling rod, to which mechanism the percussion piston of the drilling machine pumps pressure fluid during the return movement of the piston. For this purpose, the percussion piston is provided with a special ring shoulder moving in its own cylinder space separate from the cylinder space of the percussion piston. The cylinder space of the shoulder is connected with a pressure fluid source separate from the pressure fluid source for the percussion piston. A structure of this kind indeed effects a so-called stepwise rotation of the drilling rod so that the drilling rod is only rotated between the strokes on the drilling rod. Thereby the energy caused by the return movement of the percussion piston can be utilized for rotating the rotation mechanism. However, the disadvantage is that the pressure fluid pumped into the rotation mechanism is not the same as used for moving the percussion piston and consequently, two different pressure fluid circuits including separate devices and means are needed.

From U.S. Pat. No. 4,103,746 a drilling machine is earlier known, in which likewise the return movement of the percussion piston is utilized for pumping pressure fluid into the rotation mechanism. For this purpose the outlet channel of the cylinder space for the percussion piston is connected with the rotation mechanism so that the entire pressure fluid displaced during the return movement of the percussion piston flows into the rotation mechanism and to a choking means which may be provided in a by-pass channel connected in parallel with the rotation mechanism. In this construction, the same pressure fluid is indeed used for rotating the rotation mechanism as well as for moving the percussion piston, but the disadvantage is that the size of the rotation mechanism is determined by the consumption of pressure fluid required by the percussion movement of the percussion piston, which in most cases results in an overdimensioning of the rotation mechanism.

The object of the present invention is to provide a drilling machine which avoids the disadvantages mentioned above and makes it possible that only such a portion of the pressure fluid comsumption of the percussion piston which is actually needed in each case will be used by the rotation mechanism. This object is achieved by means of a drilling machine of the invention which is characterized in that the frame comprises two outlet channels ending in the cylinder space at a distance from each other in the direction of movement of the percussion piston, one of the channels being connected with the rotation mechanism and the other with the pressure fluid container.

The invention is based on the idea that the piston rod distributes the pressure fluid displaced in the cylinder space during its return movement in a proportion desired so that one part of the pressure fluid is directly passed to the fluid container and the other part to the rotation mechanism, thus producing a pressure difference over the rotation motor. By choosing this proportion suitably, it is possible to choose the pressure fluid flow to the rotation mechanism most advantageously with respect to the rotation, whereby the size of the rotation mechanism can be optimized. Therefore the size of the rotation mechanism can be choosen independently of the pressure fluid consumption of the percussion movement of the percussion piston.

Figure 2:
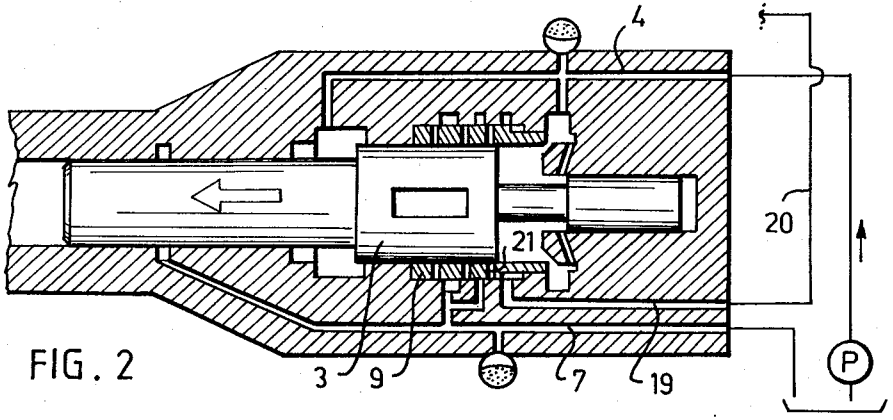
Figure 3:
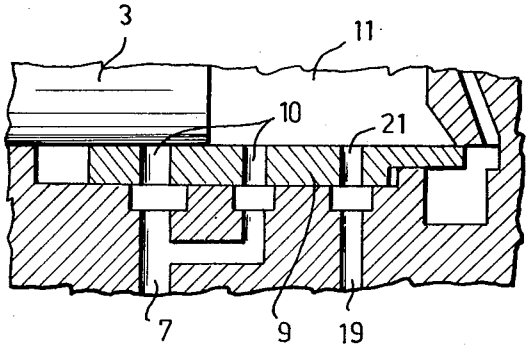

The invention is described below more closely with reference to the enclosed drawing, wherein FIG. 1 illustrates schematically an axial section of a preferred embodiment of a drilling machine according to the invention, and FIG. 2 illustrates a part of the distributing valve and the frame channels in a larger scale.

The drawing illustrates a drilling machine comprising a frame 1 which forms a cylinder space 2 for an axially moving percussion piston 3. The frame is provided with an inlet channel 4, one end of which is connected to a pressure fluid pump 5 while the other end terminates in the front chamber 6 of the cylinder space, and an outlet channel 7, one end of which is connected to a fluid container 8 while the other end terminates through two peripheral slots at a distributing valve 9 which moves axially in the cylinder space and surrounds the percussion piston. The wall of the distributing valve is provided with corresponding outlet holes 10, through which the rear chamber 11 of the cylinder space is in contact with the outlet channel 7, depending on the position of the distributing valve. By connecting the rear chamber alternately with the inlet channel and the outlet channel due to the movements of the distributing valve, it is possible to cause the percussion piston to move back and forth in the cylinder space. The construction and the operation of such a drilling machine provided with a percussion piston and a distributing valve is previously known from FI-patent specification No. 50 940. Therefore, it is not described more closely in this connection.

To the front end of the frame is rotatingly and axially movably fastened by means of bearings a drill neck 12, to which a drill rod 13 is intended to be connected. The drill neck is located at the axial extension of the percussion piston and extends to the path of movement of the percussion piston so that the back and forth movement of the percussion piston directs successive axial strokes on the end of the drill neck. Instead of a drill neck, it is possible to use as means for connecting the drill rod to the drilling machine a slot bushing known per se, inside which the end of the drill rod or the drill neck respectively is pushed in engagement with the slotted inner surface of the bushing.

The drill neck is provided with a toothing 14 and the frame supports a pressure fluid operated rotation motor 15, which by means of gears 16, 17 rotates the drill neck. Such a rotation mechanism 18 is prior art and represents only one embodiment of suitable pressure fluid operated rotation mechanisms.

The frame of the drilling machine is according to the invention provided with another outlet channel 19. One end of the channel is connected by a pipe 20 to the rotation motor 15 and the other end terminates through a peripheral slot at the distributing valve at an axial distance from the adjacent outlet channel 7 leading to the fluid container. The wall of the distributing valve is provided with corresponding outlet holes 21 at the same distance from the adjacent outlet holes 10.

The drilling machine operates as follows:

During the return movement of the percussion piston from the drill neck, when the distributing valve is positioned in the rear return position according to FIG. 1, pressure fluid flows out from the rear chamber 11 through the outlet holes 10, 21 of the distributing valve. The main part of the pressure fluid flows at first through the holes 10 into the outlet channel 7 and further to the fluid container 8, because the pressure counteracting the flow of fluid is smaller in that channel. After the percussion piston has moved to a position in which the piston closes the outlet holes 10, the rest of the pressure fluid flowing out from the rear chamber due to the return stroke flows through the outlet holes 21 into the outlet channel 19 and further through the pipe 20 to the rotation motor, which begins to rotate the drill neck and the drill rod. By proper selection of the distance between the outlet holes 21 of the outlet channel passing to the rotation motor and the outlet hole 10 as well as their position with respect to the termination of the return movement of the percussion piston, it is always possible to separate from the total quantity of pressure fluid flowing out from the rear chamber that amount of fluid, which is required for rotating the rotation motor and in each case is suitable with respect to the size of the motor.

While moving forward at the end phase of the return movement of the percussion piston, the distributing valve closes the outlet channel 7 to the fluid container and at the same time also the outlet channel 19 to the rotation motor. Thus, the percussive phase occurs in the same way as in a conventional construction. By adding a pressure accumulator in the channel passing to the rotation motor, the rotation time can be prolonged so that the motor still rotates after the valve has closed the channel.

The drawing as well as the specification relating thereto is intended only to visualize the idea of the invention. As to the details, the drilling machine of the invention can vary within the scope of the claims. The invention can also be applied to such drilling machine constructions wherein the distributing valve has been replaced by a control system of another kind.

We claim:

1. A pressurized fluid operated percussion drilling machine comprising a frame forming a cylinder space for slidable engagement with a percussion piston, the percussion piston movable axially in the cylinder space in return and percussion directions, an inlet channel and a first outlet channel located within the frame, the inlet channel and the first outlet channel being connectable to a pressurized fluid source and to a pressurized fluid container respectively to move the percussion piston in the return and the percussion directions by means of the pressurized fluid, a distributing valve adapted for controlling movement of the piston, the distributing valve axially movable in a space being independent from the cylinder space, means for attaching a drilling rod to the frame positioned as an extension of the cylinder space, a pressurized fluid operated rotational mechanism for rotating the drilling rod, said rotational mechanism being connectable to said cylinder space through a second outlet channel for rotating the rotational mechanism by means of the pressurized fluid discharging from said cylinder space, said cylinder space being divided by the movable percussion piston on two chambers, a first chamber being adjacent to said means for attaching the drilling rod to the frame and to one side of the movable percussion piston, a second chamber being defined by the other end of the movable percussion piston and a rear end of the frame, the first and the second outlet channels terminating in the second chamber, the second outlet channel being positioned in the second chamber at a predetermined distance from the first outlet channel in the return direction of the movement of the percussion piston.

2. Drilling machine according to claim 1 comprising a sleeve like distributing valve mounted axially movably in the wall of the cylinder space for controlling the connection of the cylinder space with the inlet channel and the first outlet channel respectively, the distributing valve is provided with through holes which in a return position of the distributing valve connect the cylinder space with the outlet channels located in the frame and in a percussion position close the connection of the outlet channels with the cylinder space.

3. Drilling machine according to claim 1, wherein the first outlet channel connectable to the pressure fluid container terminates in the cylinder space in at least two places positioned at a distance from each other in the direction of movement of the percussion piston.

4. Drilling machine according to claim 1 wherein said first outlet is connected with said chamber of the cylinder space.

* * * * *